US007273085B1

(12) United States Patent
Ban et al.

(10) Patent No.: US 7,273,085 B1
(45) **Date of Patent: *Sep. 25, 2007**

(54) METHOD OF DEOXIDATION CASTING AND DEOXIDATION CASTING MACHINE

(75) Inventors: Keisuke Ban, Nagano (JP); Koichi Ogiwara, Nagano (JP)

(73) Assignee: Nissin Kogyo Co., Ltd., Nagano (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/423,198

(22) Filed: Jun. 9, 2006

Related U.S. Application Data

(62) Division of application No. 10/652,304, filed on Sep. 2, 2003, which is a division of application No. 10/097,483, filed on Mar. 15, 2002, now Pat. No. 6,725,900.

(30) Foreign Application Priority Data

Mar. 15, 2001 (JP) ..... 2001-74074
Mar. 15, 2001 (JP) ..... 2001-74091
Mar. 4, 2002 (JP) ..... 2002-57063

(51) Int. Cl.
*B22D 17/04* (2006.01)

(52) U.S. Cl. ..... 164/312; 164/359

(58) Field of Classification Search ..... 164/359, 164/360, 312
See application file for complete search history.

(56) References Cited

U.S. PATENT DOCUMENTS 2,770,860 A 11/1956 Webbere
5,477,906 A * 12/1995 Legge et al. ..... 164/122.1
5,896,912 A 4/1999 Monroe et al.
6,171,363 B1 1/2001 Shekhter et al.
6,722,417 B2 4/2004 Ban et al.
6,725,900 B2 * 4/2004 Ban et al. ..... 164/56.1
6,745,816 B2 6/2004 Ban et al.
6,745,817 B2 6/2004 Ban et al.
6,802,359 B2 10/2004 Ban
6,805,191 B2 10/2004 Ban et al.
6,845,808 B2 1/2005 Ban
6,848,496 B2 2/2005 Ban et al.
6,964,293 B2 11/2005 Ban et al.
7,104,309 B2 * 9/2006 Ban et al. ..... 164/312

FOREIGN PATENT DOCUMENTS

JP 58-77765 5/1983
JP 3-230843 10/1991
JP 2000-280063 10/2000

* cited by examiner

*Primary Examiner*—Kuang Y. Lin
(74) *Attorney, Agent, or Firm*—Greenblum & Bernstein, P.L.C.

(57) ABSTRACT

Deoxidation casting machine, in which a deoxidizing compound reacts with a molten metal so as to deoxidize an oxide film formed on a surface of the molten metal. The machine includes a casting die having a molten metal inlet, a cavity into which a molten metal is poured from the molten metal inlet and a feeder head provided between the molten metal inlet and the cavity. A rate of cooling the molten metal in the feeder head is lower than that in the cavity.

18 Claims, 9 Drawing Sheets

METHOD OF DEOXIDATION CASTING AND DEOXIDATION CASTING MACHINE

CROSS-REFERENCE TO RELATED APPLICATIONS

This application is a divisional of U.S. application Ser. No. 10/652,304, filed on Sep. 2, 2003 which is a divisional of U.S. application Ser. No. 10/097,483, filed Mar. 15, 2002 now U.S. Pat. No. 6,725,900, the entire disclosures of which are hereby incorporated by reference. This application further claims priority under 35 U.S.C. §119 to Japanese Application Nos. 2001-74074 and 2001-74091, filed Mar. 15, 2001, and 2002-57063, filed Mar. 4, 2002, the entire disclosures of which are hereby incorporated by reference.

BACKGROUND OF THE INVENTION

The present invention relates to a method of deoxidation casting and a deoxidation casting machine, more precisely relates to a method of deoxidation casting, in which a molten metal left in a feeder head is properly treated, and a deoxidation casting machine capable of executing said method.

There are many kinds of ways of casting aluminum or aluminum alloy. For example, gravity casting can be executed in a simple casting die and is capable of improving quality of products. A conventional method of aluminum gravity casting will be explained with reference to FIG. 14. A splittable casting die 100 is made of a metal and constituted by a lower die section 102*a* and an upper die section 102*b*. A cavity 104, in which a product will be cast, is formed between the die sections 102*a* and 102*b*.

A molten metal inlet 106, from which a molten metal, e.g., molten aluminum, is poured, the cavity 104 and a feeder head 108, which is provided between the inlet 106 and the cavity 104, are formed in the upper die section 102*b*. Further, air ventilation holes 110, which discharge air in the cavity 104 when the molten metal is introduced into the cavity 104, are also formed in the upper die section 102*b*.

When the molten metal is solidified, about 3% of volume of the molten metal is contract. By the contraction of the molten metal filled in the cavity, a contracted part is formed in the cast product. In the casting die 100 shown in FIG. 14, the molten metal in the feeder head 108 moves toward the contracted part, by its own weight, when the molten metal in the cavity 104 is solidified. Then, the molten metal fed from the feeder head 108 fills the contracted part, so that no contracted part is formed in the cast products. Since the molten metal is supplemented from the feeder head 108 to the cavity 104 by its own weight, volume of the feeder head 108 must be great.

Fluidity of the molten metal is low in the casting die 100, so weight of the molten metal in the feeder head 108 must be heavy. Therefore, the volume of the feeder head 108 must be great so as to compulsorily supplement the molten metal. In the case of aluminum casting, for example, aluminum is apt to oxidize, so an oxide film is formed on the surface of the molten aluminum, so that the fluidity of the molten aluminum must be lower. To improve the fluidity, lubricant is applied to inner faces of the cavity 104.

To improve the fluidity of the molten aluminum and to cast a product having good external appearance without applying the lubricant, the inventors of the present invention invented a method of aluminum casting (see Japanese Patent Gazette No. 2000-280063). The method will be explained with reference to FIG. 15. A deoxidizing compound, e.g., magnesium nitride compound ($Mg_3N_2$), is introduced into the cavity 104 of the casting die 100, then the molten aluminum or aluminum alloy is poured into the casting die 100. The deoxidizing compound deoxidizes the oxide film formed on the surface of the molten aluminum or aluminum alloy, so that surface tension of the molten aluminum or aluminum alloy can be reduced, the fluidity thereof can be improved, and the product having no casting-wrinkles can be produced. Namely, high quality products can be cast.

The method using the deoxidizing compound is capable of improving the fluidity of the molten metal and well filling the molten metal in the cavity. The volume of the feeder head 108 can be reduced because the molten metal is capable of well filling the cavity 104 without using the weight of the molten metal in the feeder head 108. Therefore, the volume of the feeder head 108 may be designed on the basis of the volume reduction of the solidified metal.

In the conventional casting machine, the metal solidified in the feeder head 108 is integrated with the product solidified in the cavity 104. The metal solidified in the feeder head 108 must be cut and removed from the cast product. The removed metal will be reused as a casting material. As described above, the step of removing a disused solidified metal from the product is an essential step in the conventional method. If the volume of the feeder head 108 is great, it takes a long time to remove the disused metal. Further, energy consumption must be increased so as to melt the disused metal, which has the great volume, to reuse.

On the other hand, in the improved method disclosed in the Japanese Patent Gazette No. 2000-280063, the volume of the feeder head 108 can be designed to supplement the contracted part of the product, so the volume of the feeder head 108 can be reduced. By reducing the volume of the feeder head 108, the volume of the disused metal is also reduced, so the disused metal can be easily cut and removed from the cast product.

However, if the volume of the feeder head 108 is too small, the contracted part is formed in the vicinity of a connecting part between the disused metal and the cast product. In some cases, the contracted part is formed in the cast product. Further, if the molten metal left in the small feeder head 108 can be removed or discharged therefrom, working efficiency of the casting can be improved.

SUMMARY OF THE INVENTION

The present invention is provides a method of deoxidation casting, in which a disused metal left in a feeder head can be easily removed from a cast product, or the molten metal left in the feeder head can be removed from the cast product so as to easily finish the cast product and reduce energy consumption of the casting work.

The present invention provides a deoxidation casting machine capable of executing the method of the present invention.

To achieve the above, the present invention has following structures.

The method of deoxidation casting of the present invention comprises the steps of:

pouring a molten metal into a cavity of a casting die, which includes a feeder head provided between a molten metal inlet and the cavity; and reacting a deoxidizing compound with the molten metal so as to deoxidize an oxide film formed on a surface of the molten metal, and the method is characterized in, that rate of cooling the molten metal in the feeder head is lower than that in the cavity, and that the molten metal in the feeder head, which is not solidified, is treated when the molten metal in the cavity is solidified so as to make an outline of a cast product correspond to that of a desired product.

The deoxidation casting machine of the present invention, in which a deoxidizing compound reacts with a molten metal so as to deoxidize an oxide film formed on a surface of the molten metal, comprises a casting die having a molten metal inlet, a cavity into which a molten metal is poured from the molten metal inlet and a feeder head provided between the molten metal inlet and the cavity, wherein rate of cooling the molten metal in the feeder head is lower than that in the cavity, and the machine is characterized by, means for pressing the molten metal in the feeder head, which is not solidified, toward the cavity when the molten metal in the cavity is solidified so as to make an outline of a cast product correspond to that of a desired product.

Another deoxidation casting machine of the present invention, in which a deoxidizing compound reacts with a molten metal so as to deoxidize an oxide film formed on a surface of the molten metal, comprises a casting die having a molten metal inlet, a cavity into which a molten metal is poured from the molten metal inlet and a feeder head provided between the molten metal inlet and the cavity, wherein rate of cooling the molten metal in the feeder head is lower than that in the cavity, and the machine is characterized in, that a cavity constituting member of the casting die is separable from a feeder head constituting member thereof, and that the cavity constituting member, in which the molten metal is solidified, is separated from the feeder head constituting member while the molten metal in the feeder head is not solidified.

Further, the deoxidation casting machine of the present invention, in which a deoxidizing compound reacts with a molten metal so as to deoxidize an oxide film formed on a surface of the molten metal, comprises a casting die having a molten metal inlet, a cavity into which a molten metal is poured from the molten metal inlet and a feeder head provided between the molten metal inlet and the cavity, wherein rate of cooling the molten metal in the feeder head is lower than that in the cavity, and the machine is characterized by, means for discharging the molten metal is provided to the feeder head, wherein the molten metal in the feeder head, which is not solidified, is discharged outside when the molten metal in the cavity is solidified.

In the present invention, the product can be cast without forming a contracted part. Volume of a disused metal solidified in the feeder head can be reduced, so that the disused metal can be easily removed by proper means, e.g., a milling cutter, and working efficiency can be improved.

If the molten metal in the feeder head, which is not solidified, is removed from the cast product solidified in the cavity, no disused metal is integrated with the cast product. In this case, the molten metal in the feeder head is not solidified, so it can be easily removed from the cast product.

Since the volume of the feeder head can be reduced, energy consumption of the casting work can be reduced, and manufacturing cost can be reduced.

Since the deoxidizing compound formed on inner faces of the cavity contact the oxide film of the molten metal, the fluidity of the molten metal can be improved and the cavity can be well filled with the molten metal without applying lubricant. Further, even if the molten metal is pressurized, the cavity is not damaged. Durability can be improved, maintenance can be easily executed, and a span of life of the casting die can be extended.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

First Embodiment

The feature of the First Embodiment is shaping a cast product by pressing means.

Figure 1:
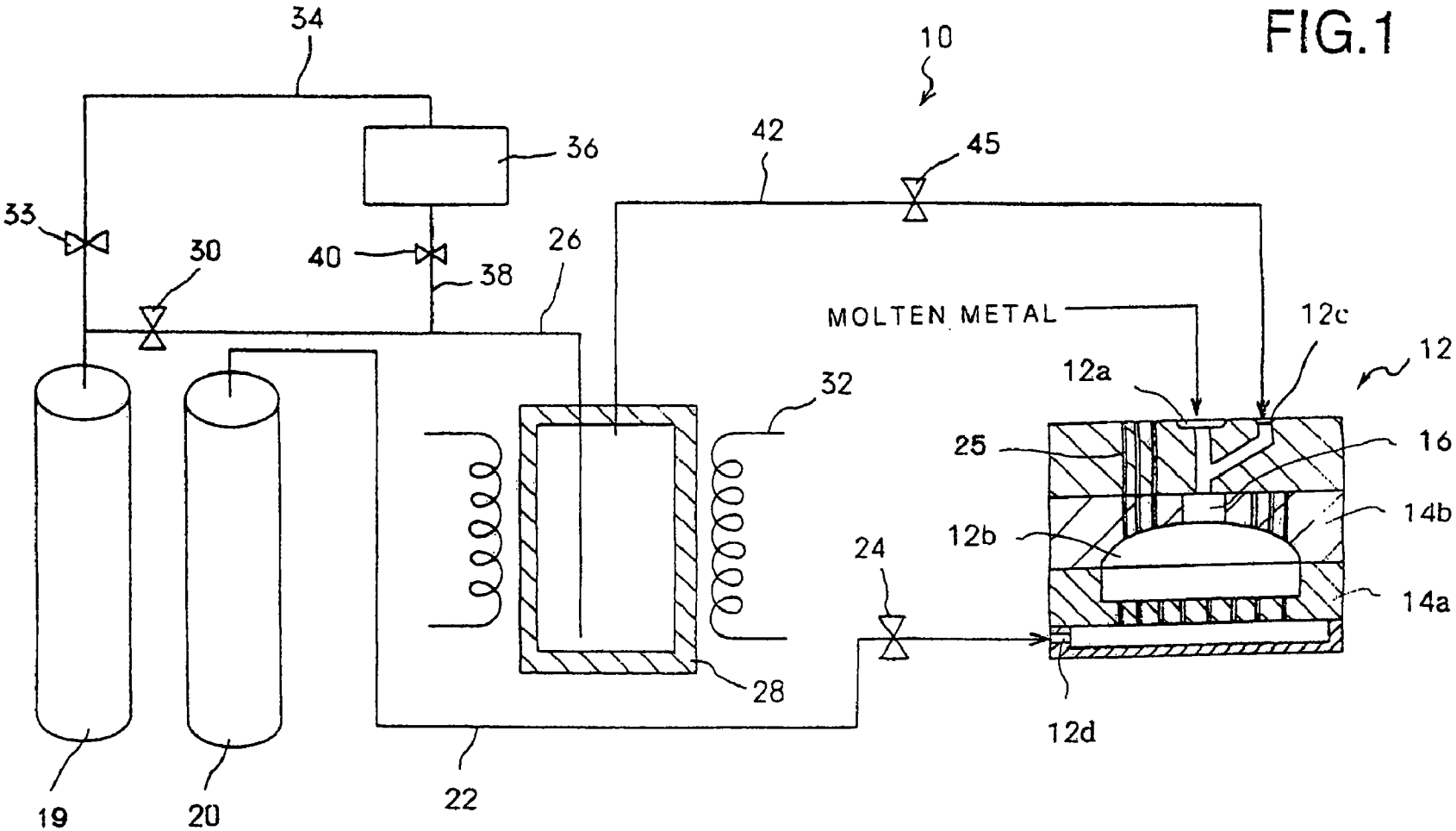
FIG. 1 is an explanation view of First Embodiment of the casting machine of the present invention.

An aluminum casting machine of the present embodiment is shown in FIG. 1.

A casting die 12 has a molten metal inlet 12*a*, from which molten aluminum or aluminum alloy is poured into the casting die 12, and a cavity 12*b* communicated to the inlet 12*a*. The casting die 12 is constituted by a lower die section 14*a* and an upper die section 14*b*. A metal of the die sections 14*a* and 14*b* are exposed in inner faces of the cavity 12*b*.

The casting die 12 is communicated to a nitrogen cylinder 20 by a pipe 22. By opening a valve 24 of the pipe 22, a nitrogen gas can be introduced into the cavity 12*b* via a gas inlet 12*d*. By introduce into the nitrogen gas, a nitrogen gas atmosphere or a substantial non-oxygen atmosphere can be produced in the cavity 12*b*.

An argon gas cylinder 19 is communicated to a furnace 28, which generates a metallic gas, by a pipe 26. By opening a valve 30 of the pipe 26, an argon gas can be introduced into the furnace 28. The furnace 28 is heated by heaters 32, and temperature in the furnace 28 rises to 800° C. or more so as to sublime magnesium powders. By subliming the magnesium powders, a magnesium gas, which is an example of metallic gases, can be generated. Amount of the argon gas introduced into the furnace 28 can be adjusted by the valve 30.

The argon gas cylinder 19 is communicated to a tank 36, in which magnesium powders are stored, by a pipe 34, to which a valve 33 is provided. The tank 36 is communicated to the pipe 26 by a pipe 38. A connecting point of the pipes 26 and 38 is located between the valve 30 and the furnace 28. A valve 40 for adjusting amount of the magnesium powders supplied to the furnace 28 is provided to the pipe 38. The furnace 28 is communicated to a metallic gas inlet 12*c* of the casting die 12 by a pipe 42. The metallic gas generated in the furnace 28 is introduced into the cavity 12 via the inlet 12*c*. A valve 45 for adjusting amount of the metallic gas supplied to the cavity 12*b* of the casting die 12 is provided to the pipe 42.

Figure 2:
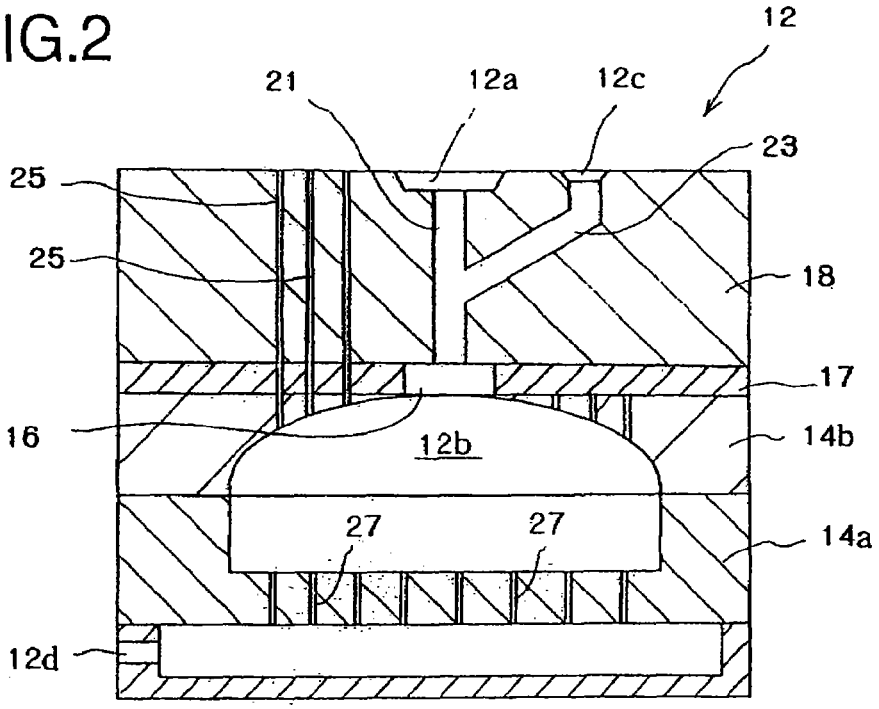
FIG. 2 is a sectional view of a casting die of the casting machine.

The casting die 12 is shown in FIG. 2. The casting die 12 includes: the lower and upper die sections 14*a* and 14*b* made of a metal; an adapter 18 made of a ceramic, e.g., calcium sulfate; and an insertion plate 17 made of a ceramic and provided between the upper die section 14*b* and the adapter 18. The die sections 14*a* and 14*b*, the insertion plate 17 and the adapter 18 are mutually separable. The splittable die sections 14*a* and 14*b* form the cavity 12*b*.

The adapter 18 includes: the molten metal inlet 12*a* from which the molten aluminum or aluminum alloy will be poured into the die 12; a molten metal path 21; the metallic gas inlet 12*c*; and a metallic gas path 23. The insertion plate 17 includes a feeder head 16 communicated to the path 21. Transverse sectional area of the feeder head 16 is broader than that of the path 21; volume of the feeder head 16 is 5-10% of volume of the cavity 12*b*.

In the present embodiment, the insertion plate 17 is inserted between the upper die section 14*b* and the adapter 18, and the feeder head 16 is formed in the insertion plate 17. With this structure, a material constituting the feeder head 16 can be different from a material constituting the upper die section 14*b*, heat conductivity of the feeder head 16 can be lower than that of the upper die section 14*b*, and the volume of the feeder head 16 can be made small. In spite of the small feeder head 16, the molten metal therein is capable of filling a contracted part of a cast product, which is formed when the molten metal is solidified. Namely, the volume of the feeder head 16 can be designed on the basis of the volume reduction of the solidified metal in the cavity 12*b*. With the small feeder head 16, a disused metal solidified in the feeder head 16 and connected to the cast product is small, so that the disused metal can be easily separated or removed from the cast product.

A plurality of air ventilation holes 25 are formed in the adapter 18, the insertion plate 17 and the upper die section 14*b* so as to discharge air from the cavity 12*b*; a plurality of gas paths 27 are formed in the lower die section 14*a* so as to introduce a nitrogen gas, which is supplied from the gas inlet 12*d*. Each of the air ventilation holes 25 and the gas paths 27 has a circular transverse sectional shape. A rectangular elongated member (not shown) is inserted in each of the air ventilation holes 25 and the gas paths 27 so as to form communication paths therein. The communication paths are communicated to the cavity 12*b*.

In the casting die 12 shown in FIGS. 1 and 2, parts of the inlet 12*a*, the path 21, the inlet 12*c*, the path 23 and the air ventilation holes 25 are formed in the adapter 18 and the insertion plate 17. Their arrangement may be designed on the basis of the shape of the cavity 12*b*, positions of pins for ejecting the cast product, etc.

In the present embodiment, the ceramic adapter 18 is employed so as to make heat-insulativity (heat insulating ability) of the adapter 18 higher than that of the die sections 14*a* and 14*b*. Since the insertion plate 17 and the adapter 18 are made of the ceramic whose heat-insulativity is higher than that of the metal of the die sections 14*a* and 14*b*, cooling rate in the feeder head 16 can be lower than that in the cavity 12*b*. Therefore, the molten metal in the feeder head 16 can be securely supplemented to the contracted part of the product in the cavity 12*b*.

Since the cooling rate in the feeder head 16 is lower than that in the cavity 12*b*, firstly the molten metal in the cavity 12*b* solidifies and contracts, then the molten metal in the feeder head 16, which is not solidified, fills the contracted part of the solidified metal in the cavity 12*b*. Namely, the molten metal in the feeder head 16 can be securely supplemented to the contracted part of the product.

Figure 5A:
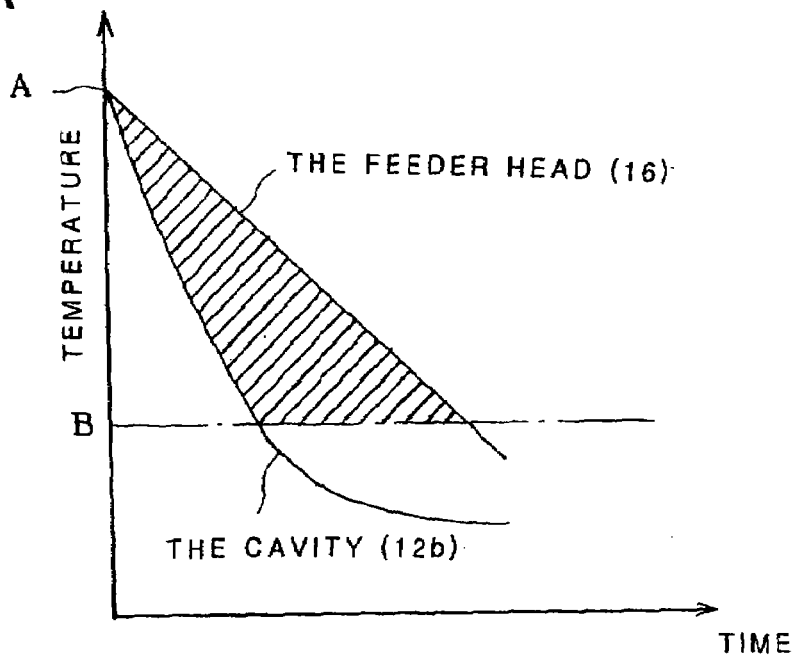
FIGS. 5A and 5B are graphs of variation of temperature in the casting die of the First Embodiment and the conventional casting die.
Figure 5B:
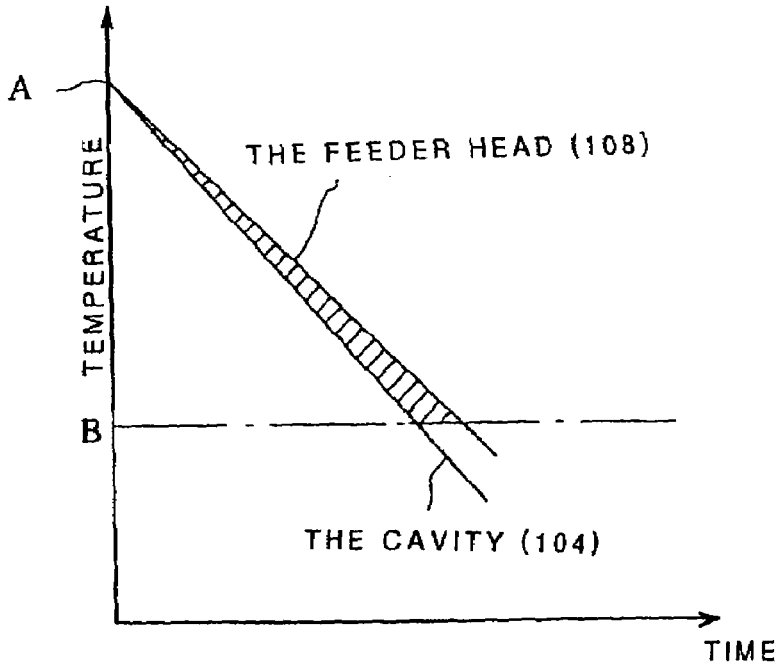

FIGS. 5A and 5B are graphs of variation of temperature in the casting die of the present embodiment and the conventional casting die. FIG. 5A shows the variation of the present embodiment, in which the deoxidizing compound reacts with the molten metal in the cavity 12*b* so as to remove the oxide film formed on the surface of the molten metal; FIG. 5B shows the variation of the conventional method.

In FIGS. 5A and 5B, temperature "A" is the temperature of the molten metal poured into the casting die; temperature "B" is temperature of completely solidifying the molten metal. In hatched ranges of the both graphs, the molten metal in the feeder head is capable of effectively supplementing the contracted part of the cast product.

The hatched range of the deoxidation casting shown in FIG. 5A is much broader than that shown in FIG. 5B because the molten metal in the cavity 12*b* of the present embodiment can be cooled until the temperature "B" in a very short time. In the deoxidation casting of the present embodiment, the fluidity of the molten metal is higher and capable of well filling the cavity, so that the molten metal can be solidified in a very short time.

On the other hand, in the conventional method shown in FIG. 5B, the fluidity of the molten metal is low, so it takes a long time to fill the cavity. Further, the volume of the feeder head is greater so as to gradually supplement the molten metal to the contracted part of the cast product with maintaining temperature of the molten metal in the feeder head. Therefore, it takes a long time to solidify the molten metal. And temperature difference between the molten metal in the feeder head and that in the cavity, so the molten metal in the feeder head cannot effectively supplement the cavity.

In the deoxidation casting of the present embodiment, difference between the cooling rate in the feeder head 16 and that in the cavity 12*b* is greater, so the molten metal in the feeder head 16 and the molten metal in the cavity 12*b* can be solidified with enough time lag. Therefore, the molten metal in the feeder head 16 can be effectively supplemented to the cavity 12*b* in spite of the small feeder head 16.

To solidify the molten metal in the feeder head 16 and the cavity 12*b* with enough time lag, the cooling rate of the molten metal in the cavity 12*b* is 500° C./min. or more (preferably 700° C./min. or more); the cooling rate of the molten metal in the feeder head 16 is less than 500° C./min. (preferably 300° C./min. or less). If the difference between the cooling rate in the feeder head 16 and the cavity 12*b* is 200° C./min. or more, the molten metal can be effectively supplemented to the cavity.

Since the insertion plate 17 and the adapter 18 are made of the ceramic whose heat-insulativity is higher than that of the metal, the difference between the cooling rate in the feeder head 16 and that in the cavity 12*b* can be effectively made greater, so that the molten metal can be effectively supplemented to the cavity.

In the present embodiment, the cavity 12*b* and the feeder head 16 are made of different materials, whose heat-insulativity are different, so as to make the difference of the cooling rate. To make the difference of the cooling rate, heat insulating lubricant, e.g., lubricant including ceramics, may be applied to an inner face of the feeder head 16.

In the case of the aluminum casting by the casting machine 10 shown in FIG. 1, firstly the valve 24 is opened to introduce the nitrogen gas into the cavity 12*b* of the casting die 12 from the nitrogen cylinder 20 via the pipe 22. By introducing the nitrogen gas, air in the cavity 12*b* can be purged. The air in the cavity 12*b* is discharged via the air ventilation holes 25 of the casting die 12, so that a nitrogen gas atmosphere or a substantial non-oxygen atmosphere can be produced in the cavity 12*b*. Then, the valve 24 is once closed.

While the air in the cavity 12*b* is purged, the valve 30 is opened to introduce the argon gas into the furnace 28 from the argon gas cylinder 19, so that a non-oxygen atmosphere is produced in the furnace 28.

Next, the valve 30 is closed, and the valve 40 is opened so as to supply the magnesium powders, which are stored in the tank 36, to the furnace 28 by gas pressure of the argon gas. The furnace 28 has been heated, by the heaters 32, at temperature of 800° C. or more so as to sublime the magnesium powders. Therefore, the magnesium powders supplied are sublimed to generate the magnesium gas.

Then, the valve 40 is closed, and the valves 30 and 45 are opened to introduce the magnesium gas into the cavity 12*b*, as the metallic gas, via the inlet 12*c* together with the argon gas, which acts as a carrier gas. Note that, pressure and amount of the argon gas are properly adjusted.

After the magnesium gas is introduced into the cavity 12*b*, the valve 45 is closed and the valve 24 is opened the nitrogen gas is introduced into the cavity 12*b* via the gas inlet 12*d* and the paths 27. By introducing the nitrogen gas into the casting die 12, the magnesium gas, which acts as the metallic gas, reacts with the nitrogen gas, which acts as the reactive gas, so that magnesium nitride ($Mg_3N_2$) compound, which is an example of the deoxidizing compound, is made. The magnesium nitride compound precipitates on the inner faces of the cavity 12*b* as powders.

When the nitrogen gas is introduced into the cavity 12*b*, pressure and amount of the nitrogen gas are properly adjusted. To easily react the nitrogen gas with the magnesium gas, the nitrogen gas may be preheated so as to maintain temperature of the casting die 12. Reaction time may be 5-90 seconds, preferably 15-60 seconds. If the reaction time is 90 seconds or longer, the casting die 12 is gradually cooled, so that reaction efficiency is made lower.

In the state that the magnesium nitride compound precipitates on the inner face of the cavity 12*b*, the molten metal (aluminum) is poured into the cavity 12*b* via the inlet 12*a*, the path 21 and the feeder head 16. The molten metal is continuously poured until the cavity 12*b*, the feeder head 16, the inlet 12*a* are filled with the molten metal.

By pouring the molten aluminum, the molten aluminum contacts the magnesium nitride compound on the inner faces of the cavity 12*b*, so that the magnesium nitride compound remove oxygen from the oxide film of the molten aluminum. By removing oxygen, the surface of the molten aluminum is deoxidized, and the surface becomes the pure aluminum surface.

Further, oxygen left in the cavity 12*b* reacts with the magnesium nitride compound, becomes magnesium oxide or magnesium hydroxide and involved in the molten metal. Amount of the magnesium oxide or magnesium hydroxide is very small, so it does not badly influence the aluminum product.

In the deoxidation casting, the magnesium nitride compound removes oxygen from the oxide film formed on the surface of the molten aluminum so as to cast the product with the pure molten aluminum having no oxide film. Therefore, surface tension of the molten metal can be reduced, wetness and fluidity of the molten metal can be improved. Surfaces of the cast product can be made highly smooth with no casting-wrinkles.

In the present embodiment, the deoxidizing compound is precipitated in the cavity 12*b* by introducing the metallic gas and the reactive gas into the cavity 12*b*. The deoxidizing compound may be supplied by other manners. For example, firstly the air in the cavity 12*b* is purged to produce the non-oxygen atmosphere therein, then the deoxidizing compound, which has been previously made outside of the cavity 12*b*, is introduced into the cavity 12*b* by a non-oxidizing gas, e.g., argon.

The molten metal in the cavity 12*b* and the feeder head 16 are cooled and solidified. In the present embodiment, as described above, the heat-insulativity of the material constituting the feeder head 16 is higher than that of the material constituting the cavity 12*b*, and the cooling rate in the cavity 12*b* is greater than that in the feeder head 16 so as to effectively supplement the molten metal from the feeder head 16 to the cavity 12*b*. Namely, when the molten metal in the cavity 12*b* is solidified, the contracted part of the solidified metal in the cavity 12*b* is filled with the molten metal in the feeder head 16, which is not solidified, so that a good product having no contracted part can be cast.

In the casting machine of the present embodiment, the adopter 18 is detached from the insertion plate 17 after the molten aluminum in the cavity 12*b* and the feeder head 16 are solidified. Then, the aluminum left in the feeder head 16 is pressed toward the cavity 12*b* by pressing means, e.g., a piston 50. By pressing the aluminum, no aluminum is left in a gate (a connecting part between the feeder head 16 and the cavity 12*b*).

Figure 3:
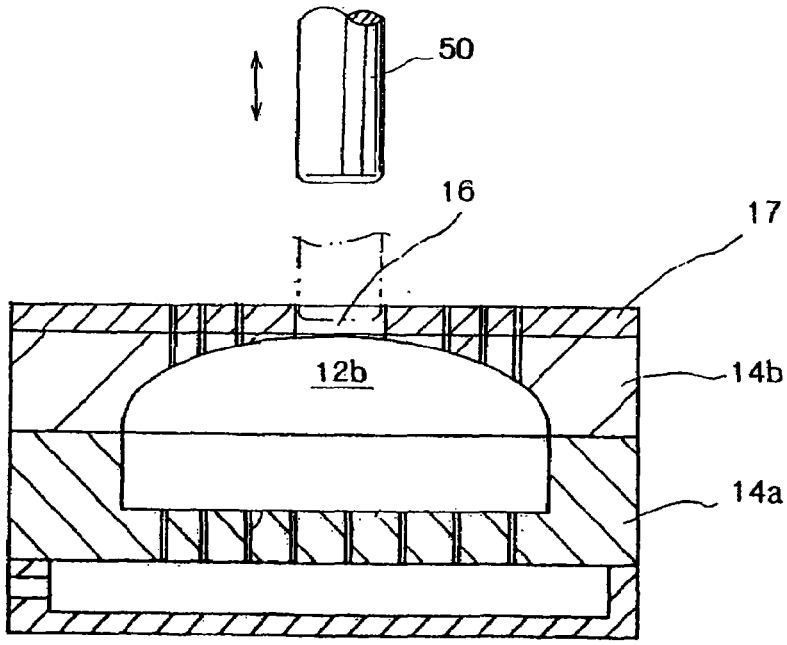
FIG. 3 is a sectional view showing a manner of pressing a molten metal in a feeder head.

In FIG. 3, the adapter 18 has been detached, and the piston 50 is inserted in the feeder head 16 to press the metal left in the feeder head 16. An outer diameter of the piston 50 is nearly equal to an inner diameter of the feeder head 16, so the piston 50 is capable of pressing and moving the metal left in the feeder head 16 toward the product in the cavity 12*b*.

Figure 4A:
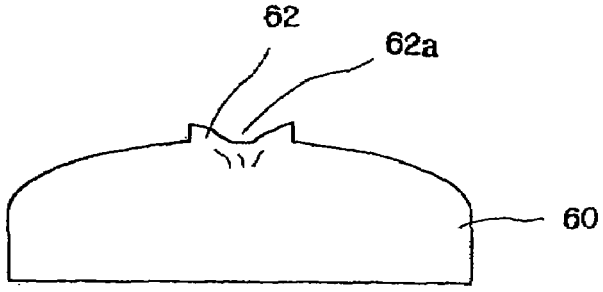
FIGS. 4A and 4B are explanation views of cast product, which are cast by pressing the molten metal in the feeder head.

The function of the piston 50 pressing the molten metal toward the cavity 12*b* will be explained with reference to FIGS. 4A and 4B. In FIG. 4A, the product 60 has been cast without using the piston 50. A recess 62*a*, which was formed when the molten metal was solidified and contracted, is formed in the metal 62 left in the feeder head 16.

Figure 4B:
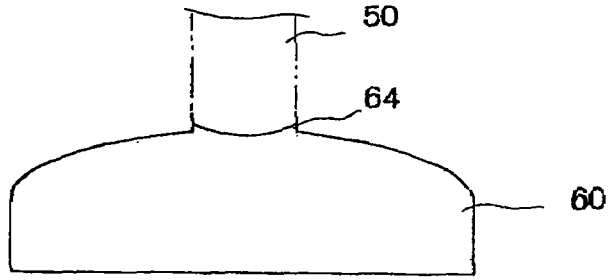

On the other hand, in FIG. 4B, the metal left in the feeder head 16 was pressed by the piston 50, so that the metal left was pressed into the product 60, so that the contracted part, which was formed when the molten metal was solidified in the cavity 12*b*, was disappeared and an outline of the product 60 corresponds to that of a desired product. Even if the metal left in the feeder head 16 is pressed, the metal 64 is left a little but it can be easily removed. Unlike the conventional method in which a large block of metal is left in the feeder head, the metal 64 of the present embodiment can be easily removed, working efficiency can be improved and energy consumption can be reduced.

The metal 64 left in the feeder head 16 is pressed before the metal 64 is perfectly solidified. Namely, the piston 50 presses the metal 64 which still has fluidity. Therefore, the piston 50 is made of or coated with a proper material whose heat-insulativity is higher than that of a metal, e.g., a ceramic. Further, as shown in FIG. 4B, a center of a lower end of the piston 50 may be projected. The contraction of the solidified metal begins from a center part, so the projected end of the piston 50 can effectively apply pressing force to the whole surface of the metal left in the feeder head 16. Therefore, the contraction can be effectively disappeared.

In the deoxidation casting, the molten metal in the feeder head 16 can effectively work, so the volume of the feeder head 16 can be smaller than that of the conventional feeder head. However, as shown in FIG. 4A, if the feeder head 16 is small, the contraction of the metal badly influences the product 60. To solve the problem, the pressing means, e.g., the piston 50, presses the metal left in the feeder head 16 to fill the contracted part of the product 60. Namely, the disadvantage of the small feeder head 16 can be solved by the pressing means. Note that, the volume of the feeder head 16 may be designed on the basis of a size of the pressing means and estimated volume of the contracted part.

Further, an opening section of the feeder head 16 may be closed by a closing member, which has high heat-insulativity, so as to maintain the fluidity of the molten metal left in the feeder head 16. By maintaining the fluidity, forming the contracted part can be prevented.

By using the piston 50 as the pressing means, the metal left in the feeder head 16 can be pressed and moved toward the cavity 12*b*, so that the contraction of the product 60 can be supplemented and the outline of the product 60 can correspond to that of the desired product.

Figure 6:
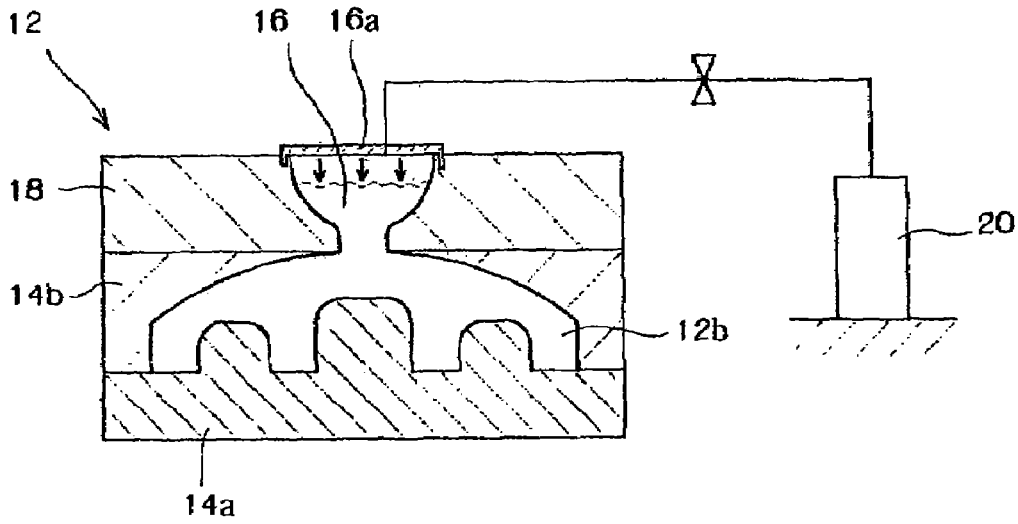
FIG. 6 is an explanation view of another example of the casting die.
Figure 7:
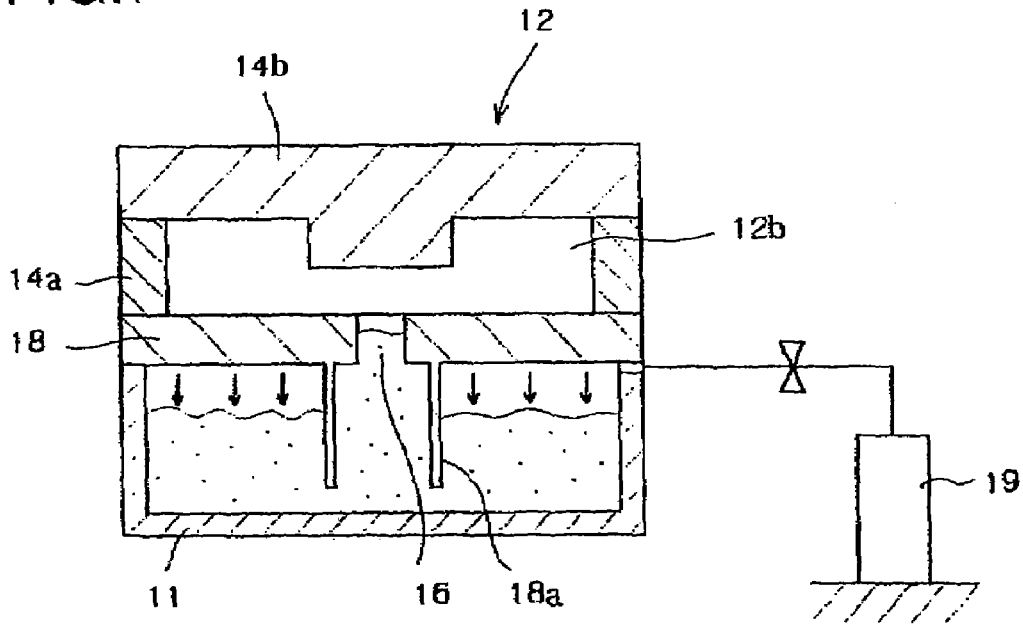
FIG. 7 is an explanation view of other example of the casting die.

In examples shown in FIGS. 6 and 7, compressed air is used as the pressing means. In FIG. 6, the feeder head 16 formed in the adapter 18 is communicated to the nitrogen cylinder 20. The opening section of the feeder head 16 is closed by a lid 16*a* after the molten metal is poured into the feeder head 16, then the nitrogen gas is introduced into the feeder head 16 from the nitrogen gas cylinder 20 so as to press the molten metal by gas pressure. Since the pressurized nitrogen gas presses the molten metal in the feeder head 16, the molten metal is moved into the cavity 12*b* and fill the contracted part of the product as well as the former example. Therefore, the outline of the product can correspond to that of the desired product.

In FIG. 7, the adapter 18 is provided to a lower part of the casting die 12, a reservoir 11 for storing the molten metal is provided under the adapter 18. The feeder head 18 communicating to the cavity 12*b* is provided in the adapter 18. A communicating pipe 18*a*, which is communicated to the feeder head 18, is downwardly extended toward an inner bottom face of the reservoir 11. The reservoir 11 is communicated to the argon gas cylinder 19. The argon gas is introduced into the reservoir 11, in which the molten metal has been stored, so as to press the molten metal by gas pressure. By pressing the molten metal, the molten metal is upwardly moved into the cavity 12*b* via the communicating pipe 18*a* and the feeder head 16. In this example, the cavity 12*b* is filled with the molten metal pressed by the argon gas, so the molten metal can be solidified in the cavity 12*b* without forming the contracted part.

In the casting machine shown in FIGS. 6 and 7, the magnesium nitride compound, which is an example of the deoxidizing compound, may be introduced into or precipitated in the cavity 12*b* so as to execute the deoxidation casting. The cooling rate in the cavity 12*b* is greater than that in the feeder head 16 as well as the former examples. Therefore, the molten metal can be securely supplemented to the cavity 12*b* from the feeder head 16. In the example shown in FIG. 7, the molten metal fills the cavity 12*b* via the feeder head 16. Pressurizing of the argon gas is stopped when the molten metal in the cavity 12*b* is solidified so as to make the disused molten metal in the feeder head 16 return to the reservoir 11.

By using gas as the pressing means (see FIGS. 6 and 7), the step of filling the cavity 12*b* with the molten metal and the step of pressing the metal in the feeder head 16 can be continuously executed. Working efficiency of the method using the gas is higher than that of the method using the piston 50.

In the deoxidation casting, the argon gas and the nitrogen gas are used, the gases can be easily used as the pressing means. Note that, the gases are not limited to the argon gas and the nitrogen gas, other gases, e.g., compressed air, may be used. Preferably, non-oxidizing gases, which hardly react with the molten metal, are used.

Second Embodiment

The feature of the second embodiment is shaping a cast product by removing the molten metal in the feeder head.

Figure 8:
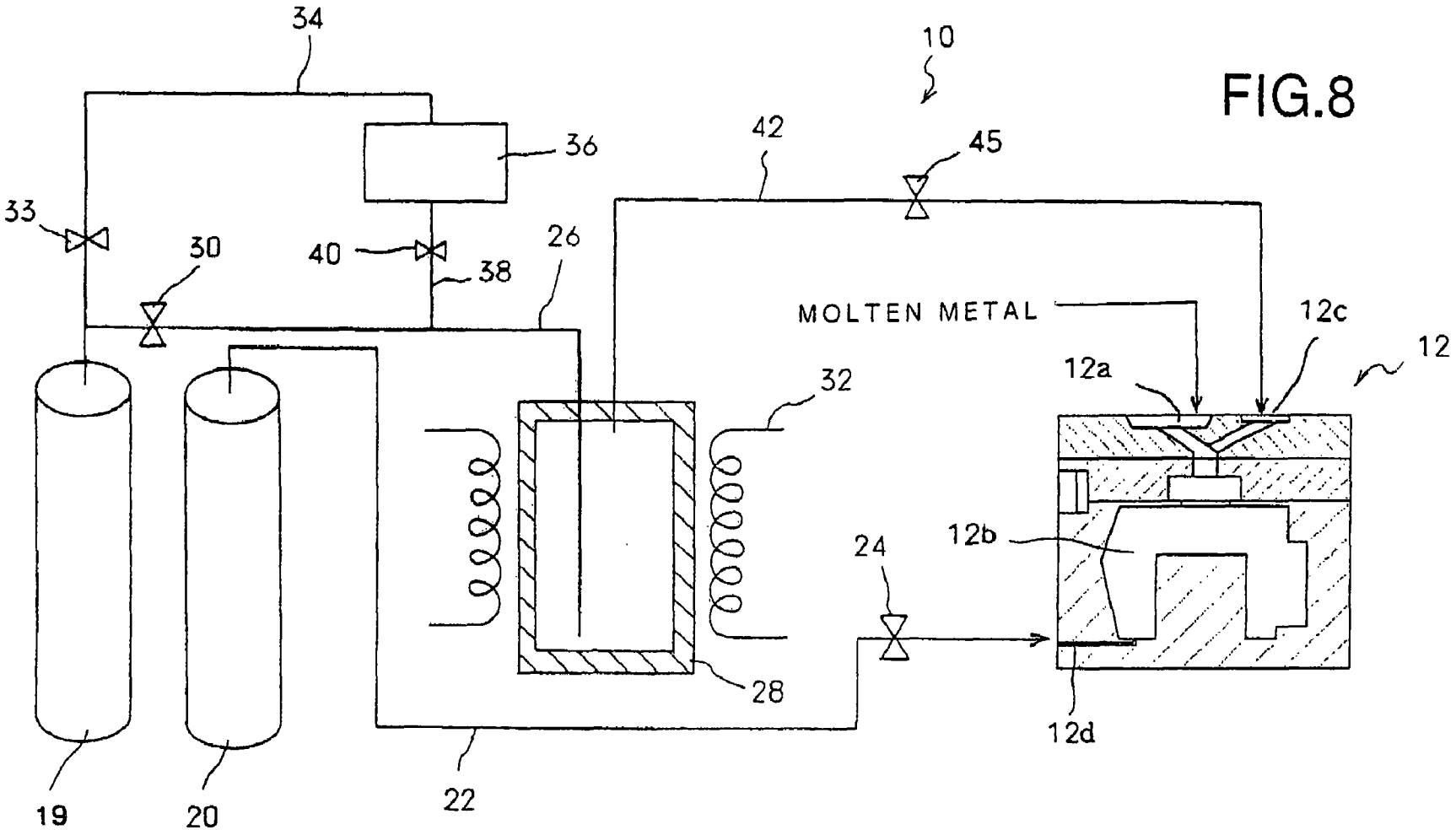
FIG. 8 is an explanation view of second embodiment of the casting machine of the present invention.

The casting machine 10 of the second embodiment is shown in FIG. 8. In FIG. 8, the elements shown in FIG. 1 are assigned to the same symbols and explanation will be omitted.

Figure 9:
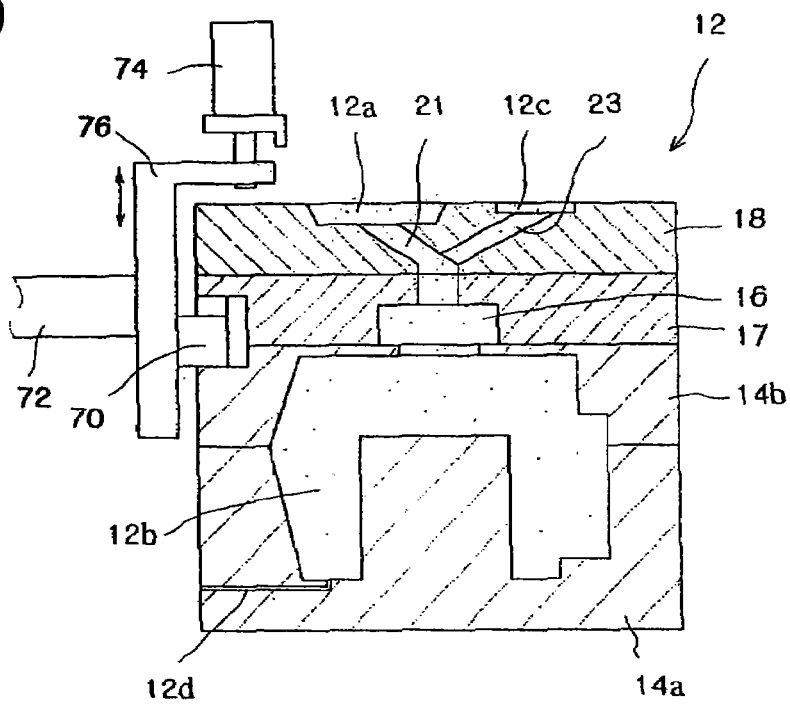
FIG. 9 is a sectional view of a casting die of the casting machine of the second embodiment.

The casting die 12 of the casting machine 10 is shown in FIG. 9. The casting die 12 includes: the lower and upper die sections 14*a* and 14*b* made of a metal; the adapter 18 made of a ceramic, e.g., calcium sulfate; and the insertion plate 17 made of a ceramic and provided between the upper die section 14*b* and the adapter 18. The die sections 14*a* and 14*b*, the insertion plate 17 and the adapter 18 are mutually supportable. The splittable die sections 14*a* and 14*b* form the cavity 12*b*.

The adapter 18 includes: the molten metal inlet 12*a* from which the molten aluminum or aluminum alloy will be poured into the die 12; the molten metal path 21; the metallic gas inlet 12*c*; and the metallic gas path 23. The insertion plate 17 includes the feeder head 16 communicated to the path 21. Transverse sectional area of the feeder head 16 is broader than that of the path 21; volume of the feeder head 16 is 5-10% of volume of the cavity 12*b*.

In the present embodiment, the insertion plate 17 is inserted between the upper die section 14*b* and the adapter 18, and the feeder head 16 is formed in the insertion plate 17. With this structure, the material constituting the feeder head 16 can be different from the material constituting the upper die section 14*b*, the heat conductivity of the feeder head 16 can be lower than that of the upper die section 14*b*, and the volume of the feeder head 16 can be made small. In spite of the small feeder head 16, the molten metal therein is capable of filling the contracted part of the cast product, which is formed when the molten metal is solidified. Namely, the volume of the feeder head 16 is much smaller than that of the feeder head of the conventional casting machine. Since the insertion plate 17 and the adapter 18 are made of the ceramic, the heat-insulativity of the both members 17 and 18 are higher than that of the die sections 14*a* and 14*b*. With this structure, solidification time of the molten metal in the feeder head 16 is longer than that of the molten metal in the cavity 12*b*.

In FIG. 9, a clamper 70 clamps the die sections 14*a* and 14*b*. A driving rod 72 presses the clamper 70, and a driving unit 74 drives the clamper 70. The rod 72 is driven by a proper mechanism, e.g., a motor, so as to move the clamper 70 in the horizontal direction; the driving unit 74 moves the clamper 70 in the vertical direction. A symbol 76 stands for an arm. In FIG. 9, the clamper 70 has been moved rightward and downward, so that the die sections 14*a* and 14*b* are engaged and the insertion plate 17 and the adapter 18 are assembled. The cavity 12*b* is formed between the die sections 14*a* and 14*b*. The cavity 12*b* and the inlet 12*a* are communicated by the feeder head 16 and the path 21; the cavity 12*b* and the inlet 12*c* are communicated by the feeder head 16 and the path 23. In the state shown in FIG. 9, the molten metal is poured into the cavity 12*b* so as to cast the product.

The deoxidation casting is executed in the casting machine 10 shown in FIG. 9 as well as the First Embodiment shown in FIG. 1. Namely, The air in the cavity 12*b* is purged by introducing the nitrogen gas so as to produce the non-oxygen atmosphere therein. Then the magnesium gas is introduced into the cavity 12*b* via the inlet 12*c* together with the argon gas, which acts as a carrier gas. Next, the nitrogen gas is introduced into the cavity 12*b* via the gas inlet 12*d*. By introducing the nitrogen gas into the casting die 12, the magnesium gas reacts with the nitrogen gas, so that the magnesium nitride ($Mg_3N_2$) compound is precipitates on the inner faces of the cavity 12*b* as powders.

In the state that the magnesium nitride compound precipitates on the inner face of the cavity 12*b*, the molten metal (aluminum) is poured into the cavity 12*b* via the inlet 12*a*, the path 21 and the feeder head 16.

By pouring the molten aluminum, the molten aluminum contacts the magnesium nitride compound on the inner faces of the cavity 12*b*, so that the magnesium nitride compound remove oxygen from the oxide film of the molten aluminum. By removing oxygen, the surface of the molten aluminum is deoxidized, and the surface becomes the pure aluminum surface.

Since the insertion plate 17 and the adapter 18 are made of the ceramic, the heat-insulativity of the both members 17 and 18 are higher than that of the die sections 14*a* and 14*b*. Namely, the cooling rate of the molten metal in the feeder head 16 is lower than that in the cavity 12*b*. Therefore, firstly the molten metal in the cavity 12*b* is solidified, then the molten metal in the feeder head 16 is solidified; the molten metal in the feeder head 16 can be securely supplemented to the contracted part of the product in the cavity 12*b*. By employing the ceramic plate 17 and the ceramic adapter 18 whose heat-insulativity is higher than that of the metal of the die sections 14*a* and 14*b*, the difference of the cooling rate between the feeder head 16 and the cavity 12*b* can be made great, so the molten metal in the feeder head 16 can be effectively supplemented to the cavity 12*b*.

In the present embodiment, the casting die 12 can be divided into two parts: a cavity part including the cavity 12*b* and a feeder head part including the feeder head 16. The casting die 12 is divided or separated when the molten metal in the cavity 12*b* is solidified and the molten metal in the feeder head 16 is not solidified. By dividing the casting die 12, the metal left in the feeder head 16 can be securely removed from the cast product in the cavity 12*b*.

Figure 10:
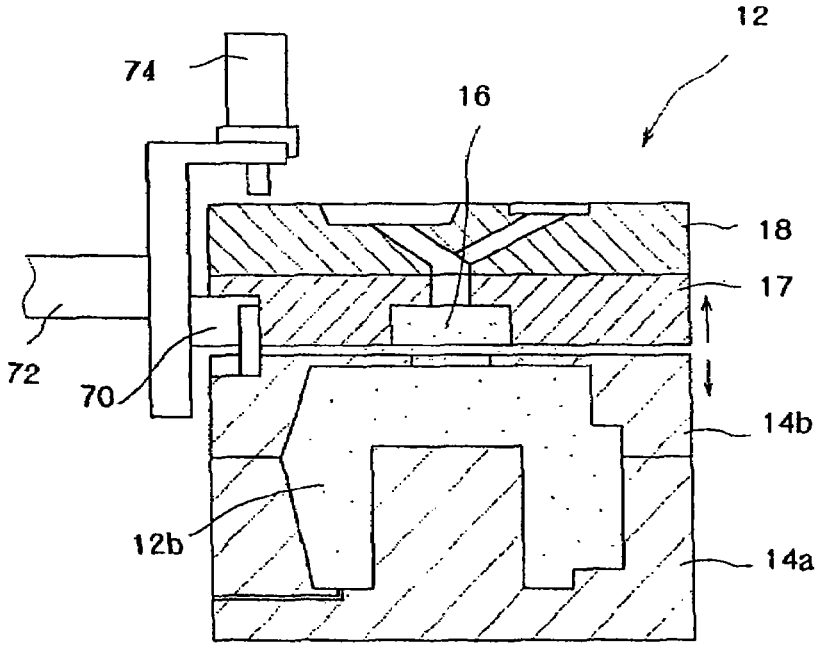
FIG. 10 is a sectional view of the casting die, in which an insertion plate is separated from an upper die section.

In FIG. 10, the cavity 12*b* is filled with the solidified metal, and the metal in the feeder head 16 is half-solidified. The insertion plate 17 and the adapter 18 are separated from the upper die section 14*b*. When the casting die 12 is opened, firstly the clamper 70 is moved upward so as to separate the insertion plate 17 and the adapter 18 from the upper die section 14*b*, then the clamper 70 is moved leftward so as to open the die sections 14*a* and 14*b*.

By separating the insertion plate 17 and the adapter 18 from the upper die section 14*b* as shown in FIG. 10, the metal left in the feeder head 16 can be removed from the cast product. At that time, the metal in the cavity 12*b* has been fully solidified but the metal in the feeder head 16 is half-solidified, so the metal left in the feeder head 16 can be easily separated or removed when the casting die 12 is opened.

In the present embodiment, the difference of the cooling rate between the feeder head 16 and the cavity 12*b* is great, so the metal left in the feeder head 16, which is half-solidified, is removed from the cast product, which is fully solidified. Since the metal left in the feeder head 16 is half-solidified, it can be easily removed.

Note that, the metal left in the feeder head 16 may be removed by other means.

Figure 11:
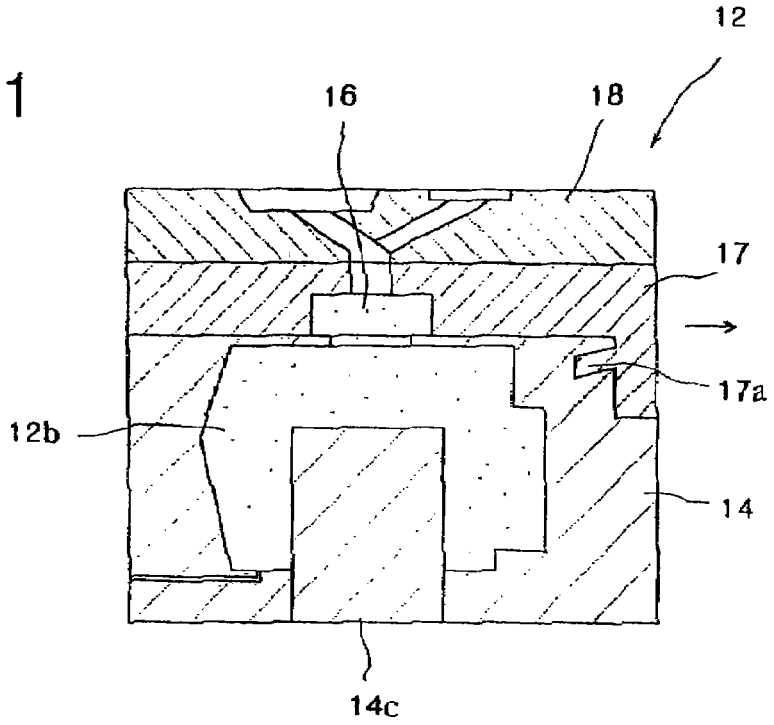
FIG. 11 is a sectional view of the casting die having an inclined pin.

In an example shown in FIG. 11, the insertion plate 17 and the adapter 18 are separated from a splittable die 14. An inclined pin 17*a* is provided to the insertion plate 17. When the insertion plate 17 is slid with respect to the die 14, the insertion plate 17 is separated from the die 14. An insert die section 14*c* is inserted in the cavity 12*b*. A plurality of the die sections constitute the die 14. Since the insertion plate 17 and the adapter 18 are separated when the splittable die 14 is opened, the metal left in the feeder head 16 can be removed from the cast product.

Figure 12:
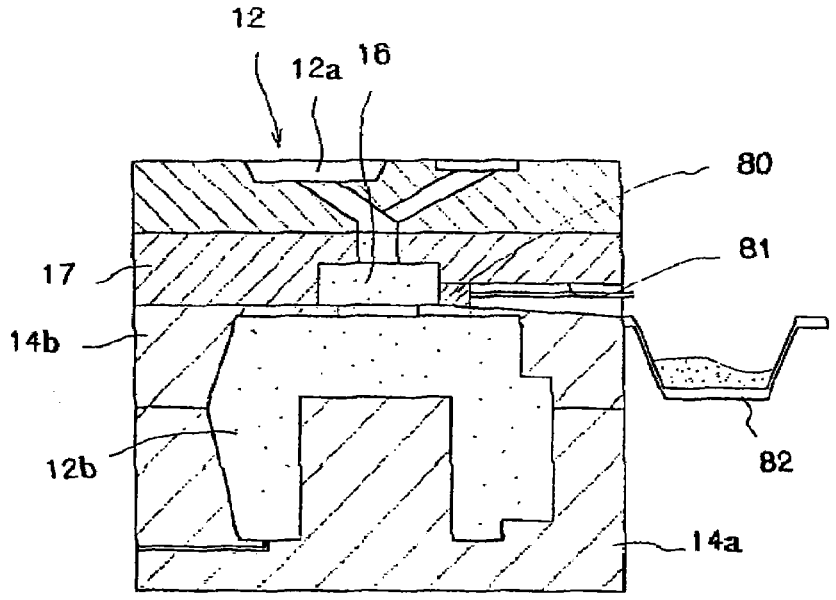
FIG. 12 is a sectional view of the casting die having closing means.
Figure 14:
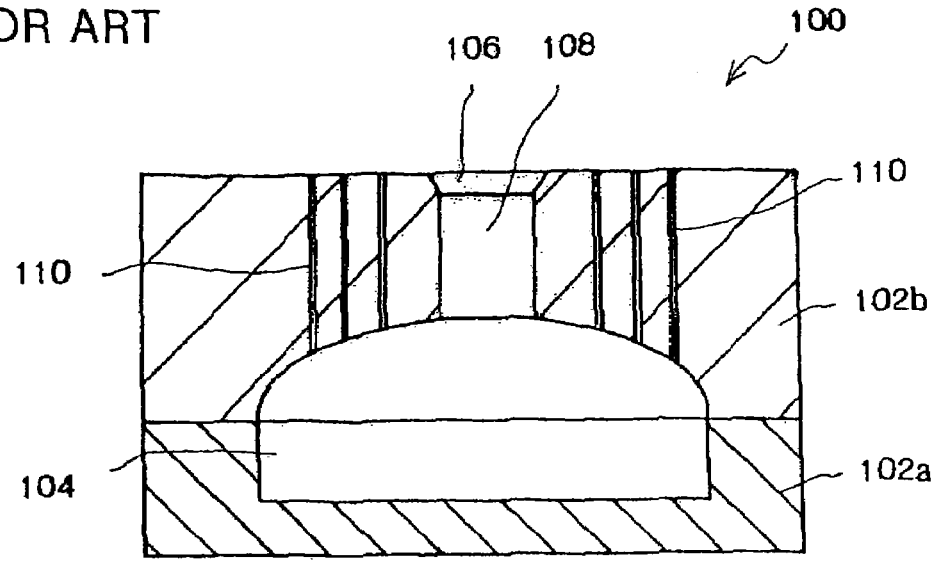
FIG.14 PRIOR ART
FIG. 14 is the sectional view of the casting die of the conventional casting die.
Figure 15:
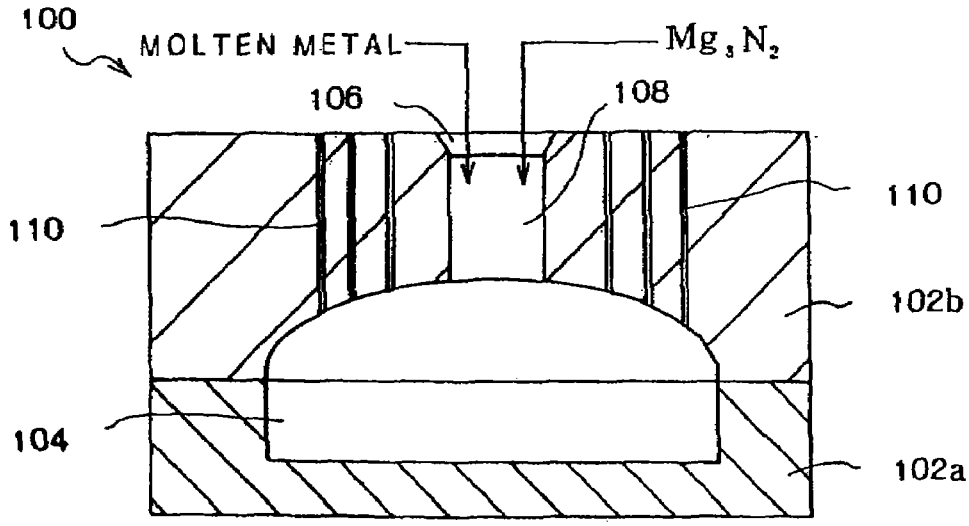
FIG.15 PRIOR ART
FIG. 15 is the explanation view showing the conventional deoxidation casting.

In an example shown in FIG. 12, the molten metal in the feeder head 16, which is not solidified, is discharged outside of the casting die 12. When the molten metal is discharged, the metal in the cavity 12*b* has been fully solidified. A side path 81, which communicates the feeder head 16 to an outer face of the casting die 12, is formed in the insertion plate 17. A closing member 80, which is capable of closing and opening the side path 81, is slidably provided in the side path 81. The molten metal discharged outside is received by a container 82.

FIG. 12 shows a state of casting the product. Namely, the side path 81 is closed by the closing member 80. The molten metal is poured in the cavity 12*b* and the feeder head 16. When the molten metal in the cavity 12*b* is solidified, the closing member 80 is removed from the side path 81 so as to discharge the molten metal in the feeder head 16 to the container 82 via the side path 81. In the case that the difference of the cooling rate between the feeder head 16 and the cavity 12*b* is great and the fluidity of the molten metal is high, the casting die 12 shown in FIG. 12 is effective.

Figure 13:
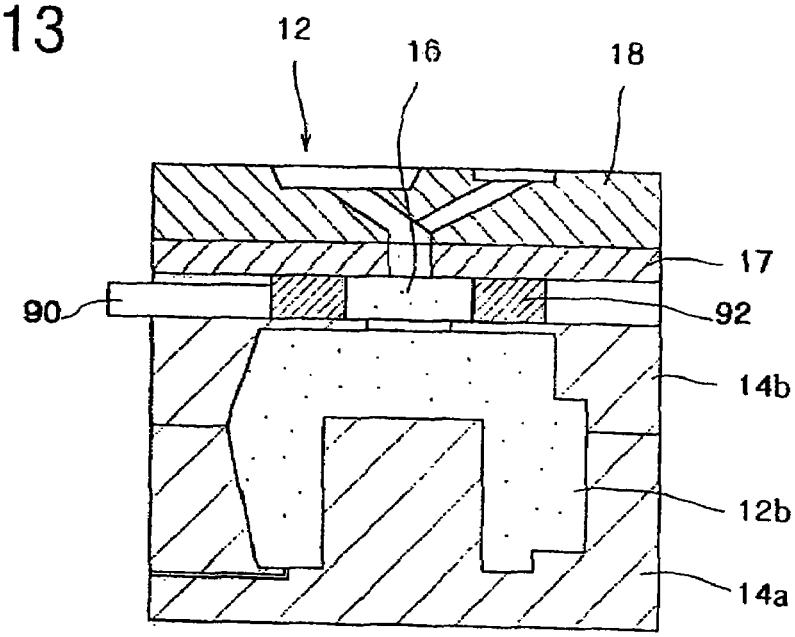
FIG. 13 is a sectional view of the casting die having a pusher.

In an example shown in FIG. 13, the metal in the feeder head 16 is pushed out or ejected by a pusher 90. By pushing the metal, the metal left in the feeder head 16 can be removed from the cast product in the cavity 12*b*. A sliding member 92 is horizontally moved to cross a gate of the cavity 12*b*. The sliding member 92 is moved by the pusher 90.

FIG. 13 shows a state of casting the product. The molten metal is poured in the cavity 12*b* and the feeder head 16. When the molten metal in the cavity 12*b* is solidified and the molten metal in the feeder head 16 is not solidified, the sliding member 92 is moved, by the pusher 90, from a first position, at which the sliding member 92 opens the gate of the cavity 12*b*, to a second position, at which the sliding member 92 closes the gate thereof. With this action, the metal left in the feeder head 16 can be removed from the cast product.

When the sliding member 92 reaches the second position, the casting die is opened and the cast product, from which the disused metal formed in the feeder head 16 has been removed, can be taken out. Note that, the pusher 90 may move the sliding member 92 to a third position, at which the disused metal can be taken out. In FIG. 13, thickness of the sliding member 92 is equal to height of the feeder head 16, but the thickness of the sliding member 92 may be thinner than the height of the feeder head 16. In any cases, the sliding member 92 is moved to cross the gate, which communicates the feeder head 16 to the cavity 12*b*.

In the example shown in FIG. 13, the metal left in the feeder head 16 is mechanically removed from the cast product at the gate of the cavity 12*b*, so the metal in the feeder head 16 can be securely removed from the cast product even if the metal in the feeder head 16 is half-solidified.

In the deoxidation casting of the present invention, the metal left in the feeder head, which is not solidified (in a liquid phase), is removed or discharged when the metal in the cavity is solidified (in a solid phase). With this feature, the metal molten or solidified in the feeder head can be easily and securely removed. A step of removing the disused metal from the product can be omitted or easily executed, so that working efficiency can be improved.

In the present invention, the disused metal left in the feeder head is removed before it is fully solidified, so it can be easily removed. And, energy consumption for melting the removed metal to reuse can be reduced.

In the above described embodiments, the molten aluminum or aluminum alloy is used as the molten metal. The molten metal is not limited to the embodiments. Iron, magnesium, magnesium alloy, etc. may be applied to the present invention.

The invention may be embodied in other specific forms without departing the spirit or essential characteristics thereof. The present embodiments are therefore to be considered in all respects as illustrative and not restrictive, the scope of the present invention being indicated by the appended claims rather than by the foregoing description and all changes which come within the meaning and range of equivalency of the claims are therefore intended to be embraced therein.

What is claimed is:

1. A deoxidation casting machine, structured and arranged for gravity casting, and in which a deoxidizing compound reacts with a molten metal so as to deoxidize an oxide film formed on a surface of the molten metal, comprising a casting die having a molten metal inlet, a cavity into which a molten metal is poured from the molten metal inlet and a feeder head provided between the molten metal inlet and the cavity, wherein rate of cooling the molten metal in the feeder head is lower than that in the cavity, and a cavity constituting member of the casting die being separable from a feeder head constituting member thereof, and the cavity constituting member, in which the molten metal is solidified, is separated from the feeder head constituting member while the molten metal in the feeder head is not solidified, wherein the cavity constituting member has a thermal conductivity which produces a cooling rate of the molten metal in the cavity to be at least 500° C./min. and the feeder head constituting member has a thermal conductivity which provides a cooling rate of the molten metal in the feeder head to be less than 500° C./min.

2. A deoxidation casting machine, in which a deoxidizing compound reacts with a molten metal so as to deoxidize an oxide film formed on a surface of the molten metal, comprising a casting die having a molten metal inlet, a cavity into which a molten metal is poured from the molten metal inlet and a feeder head provided between the molten metal inlet and the cavity, wherein rate of cooling the molten metal in the feeder head is lower than that in the cavity, and means for discharging the molten metal is provided to the feeder head, wherein the molten metal in the feeder head, which is not solidified, is discharged outside when the molten metal in the cavity is solidified, wherein the cavity constituting member has a thermal conductivity which produces a cooling rate of the molten metal in the cavity to be at least 500° C./min. and the feeder head constituting member has a thermal conductivity which provides a cooling rate of the molten metal in the feeder head to be less than 500° C./min.

3. The deoxidation casting machine of claim 1, further comprising an assembly arranged to introduce the deoxidizing compound into the cavity.

4. The deoxidation casting machine of claim 3, wherein the assembly comprises an argon gas supply, a nitrogen gas supply, and a furnace.

5. The deoxidation casting machine of claim 3, wherein the deoxidizing compound comprises magnesium nitride.

6. The deoxidation casting machine of claim 1, further comprising a device arranged to separate the feeder head constituting member from the cavity constituting member.

7. The deoxidation casting machine of claim 6, wherein the device comprises a clamp apparatus that moves the feeder head constituting member upward relative to the cavity constituting member.

8. The deoxidation casting machine of claim 6, wherein the device comprises an inclined pin along which the feeder head constituting member slides relative to the cavity constituting member.

9. The deoxidation casting machine of claim 2, further comprising an assembly arranged to introduce the deoxidizing compound into the cavity.

10. The deoxidation casting machine of claim 9, wherein the assembly comprises an argon gas supply, a nitrogen gas supply, and a furnace.

11. The deoxidation casting machine of claim 9, wherein the deoxidizing compound comprises magnesium nitride.

12. The deoxidation casting machine of claim 2, wherein the means for discharging the molten metal comprises a path that communicates the feeder head to an outer face of the casting die.

13. The deoxidation casting machine of claim 12, wherein the path is formed in the feeder head constituting member.

14. The deoxidation casting machine of claim 12, wherein the means for discharging the molten metal further comprises a closing member arranged to open and close the path.

15. The deoxidation casting machine of claim 2, wherein the means for discharging the molten metal comprises a sliding member and a pusher.

16. The deoxidation casting machine of claim 15, wherein the pusher is arranged to move the sliding member from a first position, at which the sliding member opens a gate of the cavity, to a second position, at which the sliding member closes the gate.

17. The deoxidation casting machine of claim 2, wherein the deoxidation casting machine is structured and arranged to perform gravity casting.

18. A deoxidation casting machine, in which a deoxidizing compound reacts with a molten metal so as to deoxidize an oxide film formed on a surface of the molten metal, comprising a casting die having a molten metal inlet, a cavity into which a molten metal is poured from the molten metal inlet and a feeder head provided between the molten metal inlet and the cavity, wherein rate of cooling the molten metal in the feeder head is lower than that in the cavity, and means for discharging the molten metal is provided to the feeder head, wherein the molten metal in the feeder head, which is not solidified, is discharged outside when the molten metal in the cavity is solidified, wherein:

the means for discharging the molten metal comprises a sliding member and a pusher, the pusher is arranged to move the sliding member from a first position, at which the sliding member opens a gate of the cavity, to a second position, at which the sliding member closes the gate, and the pusher is arranged to move the sliding member to a third position, at which unused metal may be taken out of the feeder head.

* * * * *